United States Patent [19]

Vilella

[11] Patent Number: 4,799,620

[45] Date of Patent: Jan. 24, 1989

[54] CORNER CONSTRUCTION OF STACKABLE CARDBOARD BOX

[75] Inventor: Antonio R. Vilella, Amposta, Spain

[73] Assignee: Daniel Aguilo Panisello S.A., Amposta, Spain

[21] Appl. No.: 937,985

[22] Filed: Dec. 4, 1986

[30] Foreign Application Priority Data

Jan. 29, 1986 [ES] Spain ..... 292.019

[51] Int. Cl.[4] ..... B65D 21/02

[52] U.S. Cl. ..... 229/191; 206/509; 206/512; 229/49; 229/918

[58] Field of Search ..... 229/49, 191, 918, DIG. 11; 206/509, 511, 512, 821

[56] References Cited

U.S. PATENT DOCUMENTS

| | | | |
|---|---|---|---|
| 2,885,140 | 5/1959 | Guyer | 229/191 |
| 3,268,147 | 8/1966 | Burger | 229/191 |
| 3,270,943 | 9/1966 | Polenghi | 229/49 |
| 3,372,813 | 3/1968 | Ishida | 229/49 |

FOREIGN PATENT DOCUMENTS

| | | | |
|---|---|---|---|
| 1185987 | 1/1965 | Fed. Rep. of Germany | 206/821 |
| 2604052 | 8/1977 | Fed. Rep. of Germany | 206/821 |
| 1546311 | 11/1968 | France | 229/191 |
| 2514323 | 4/1983 | France | 206/512 |
| 698010 | 11/1965 | Italy | 229/DIG. 11 |

*Primary Examiner*—Stephen Marcus
*Assistant Examiner*—Gary E. Elkins
*Attorney, Agent, or Firm*—Robert E. Burns; Emmanuel J. Lobato

[57] ABSTRACT

A stackable cardboard box construction comprises a sheet of corrugated cardboard cut, grooved and folded to form a bottom panel, opposite side walls and opposite lengthwise walls united with the bottom by grooved fold lines. At each corner, the side walls and lengthwise walls have upwardly projecting tabs and are folded to form a hollow triangular column having double thickness walls and projecting up above the upper edges of the side walls and lengthwise walls. A triangular plastic cap fitting over the projecting upper end of each of the columns has a stop plane engaging the top of the respective column, a table spaced above the stop plane by reinforcing ribs and a frustoconical stud which projects up from the table and is received in an opening in the bottom of a next higher box in a stack to prevent side slipping.

4 Claims, 1 Drawing Sheet

CORNER CONSTRUCTION OF STACKABLE CARDBOARD BOX

FIELD OF INVENTION

The present invention relates to stackable cardboard boxes and in particular to the corner construction of such boxes.

BACKGROUND OF THE INVENTION

This type of box is being used more and more for the packing and transportation of fruit and all types of perishable products due to the fact that present technology has been progressively creating and applying new concepts of substantial simplification in shape and assembly which greatly reduce the cost of the construction of the finished package and parallel improvements in the manufacture of the raw material used, namely the corrugated cardboard.

Logically the above-mentioned improvements have been applied and used based on certain properties of strength of the corners of such boxes, a condition indispensible for stacking in which the lower boxes must support the weight of the upper boxes and of the contents thereof, for which reason there have been utilized corner pillars of high resistance to collapsing and different solutions are also being employed to avoid the sliding of such boxes when they are stacked, thereby avoiding the upper boxes dropping down sideways by sliding off from the lower boxes.

In this connection there are already known the solutions provided by Spanish Utility Model No. 266,431 of the present applicant and Spanish Utility Model No. 272,042, also of the present applicant, in accordance with which the assembled box comprises in all of its parts a single thickness of material, except at its corners where the pillars are constructed by the superimposed doubling of a series of panels which form an extension of the sides of the box and have two or three thicknesses. In these solutions, when assembling the box, there are eliminated the operations of gluing or stapling the parts of the side walls and lengthwise walls which come together at each corner, since the upper portions of the components of each pillar are connected together by fitting within a cap of plastic material of the shape of a prism with a triangular base with a lower opening to receive said parts of the pillar, this being the only manner of assembling and adjusting the pillar.

SUMMARY OF THE INVENTION

In the preferred corner arrangement in accordance with the present invention, the same guidelines are maintained as in the aforementioned utility models but with substantial variations which provide the following advantages over what has already been tried and disclosed.

In the lengthwise walls of the box, series of panels are incorporated which, upon being suitably folded, form triangular corner pillars. This makes it possible to most closely approximate the development of the box blank as a rectangular figure in which there is avoided on the periphery the waste of material which up to now has increased the total cost of the box.

The box is provided with suitable means which assure centering upon stacking and prevent accidental disassembly.

On the plastic caps or reinforcements for assembling the corners of the box, there is provided a supplement which produces an increase in the space between the superimposed boxes, such cap being formed with suitable fitting edges which in addition to facilitating the superimposing of the immediately higher box, decrease the cost of the molds and fundamentally, by producing the aformentioned spacing of the superimposed boxes, permit a greater height of stacking without it being necessary to increase the dimensions of its blank and thus the height of its side walls and lengthwise walls.

On each corner there is developed a hollow pillar of triangular shape each of the sides of which comprises two thicknesses of material.

BRIEF DESCRIPTION OF THE DRAWINGS:

The nature, object and advantages of the invention will appear more fully from the following description of a preferred embodiment shown by way of example in the accompanying drawings in which.

Figure 1:
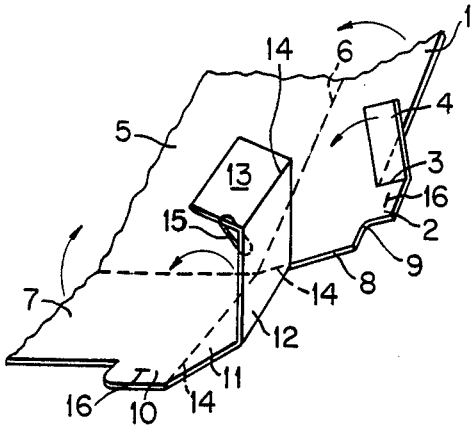
FIG. 1 is a perspective view of one of the four corners of the box blank upon during the folding thereof.

DESCRIPTION OF PREFERRED EMBODIMENT:

As shown in FIG. 1 the panel of the side wall 1 has at its end a protruding tab 2 which is separated from a flap 4 of the same height by a longitudinal groove 3 for folding towards the inside. This side wall 1, in its turn, is clearly differentiated from the panel of the bottom 5 of the box by a longitudinal groove 6 for folding towards the inside, similar to the one which separates the panel of the bottom 5 from the panel of the lengthwise wall 7, it thus being separated from the end of the panel of the side wall 1 by a cut line 8 which widens its end by a notch 9. The panel of the lengthwise wall 7 has on its edge a tab 10 which is of the same height as the projection extending from the panel of the side wall 1.

The tab 10 of the panel of the lengthwise wall 7 is extended by three successive panels 11, 12 and 13 which are separated from each other and from the lengthwise wall side 7 by longitudinal parallel grooves 14 for folding towards the inside.

In the bottom panel 5 and in each of its corners there is a diagonal slotted opening 15 which is fundamental for the centering and stability of the individual superimposed boxes.

Figure 2:
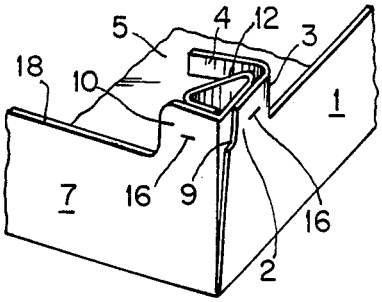
FIG. 2 is a perspective view of the corner shown in FIG. 1, in assembled arrangement, thus forming one of the four corner pillars of the box.

In the protruding tabs 2 and 10 of the panel of the side wall 1 and of the panel of the lengthwise wall 7 respectively angular notches are present which, in the process of assembly, collaborate in fastening the prismatic-triangular cap 17 which secures the corner and the parts of which are located in the manner shown in FIG. 2 with the successive panels 11, 12 and 13 folded to form triangular prism in such manner that the end panel 13 is against the inner face of the tab 10, thereby forming, in a double thickness, one of the legs of the triangular section of the prism which constitutes the corner pillar. The other leg is formed by the superimposing of the panel 11 over the protruding tab 2 of the panel of the side wall 1 and, similarly, the hypotenuse is formed by the superimposing of the lug 4 of the side panel, the lug being folded over the panel 12.

Figure 3:
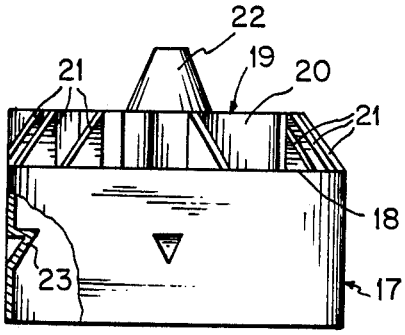
FIG. 3 is a front view of the assembly cap, provided with reinforcement ribs, table and frustoconical lug as well as one of the retaining teeth.
Figure 4:
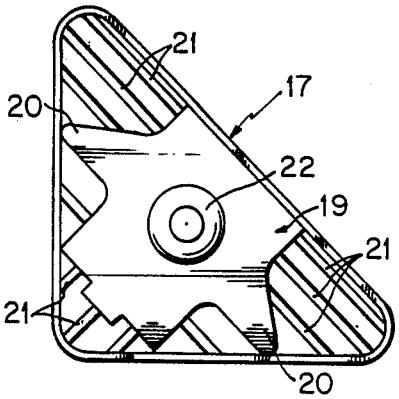
FIG. 4 is a top view of the assembly cap of FIG. 3 showing the arrangement of all of its elements.
Figure 5:
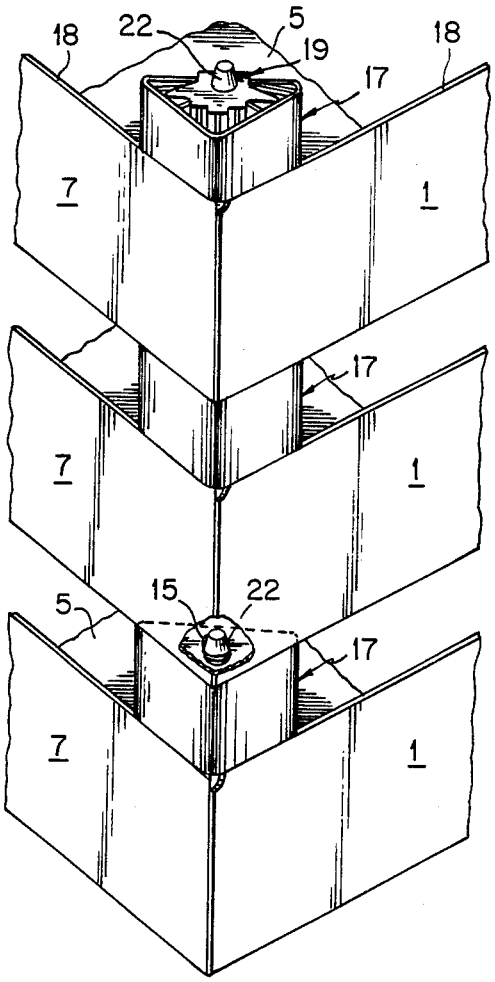
FIG. 5 is a perspective view of the aligned corners of three stacked boxes, provided with their corresponding triangular-prism caps; with a corner of the uppermost box broken away in order to permit a view of the inside, in which there can be noted the grooved orifice connected to the frustoconical lug of the triangular-prism cap of the immediately lower box.

The hollow rectangular-prism pillar is superimposed upon assembly over the slotted opening 15 located in the panel of the bottom 5, while the upper end of said hollow pillar is introduced in fitted manner, into the inside of the abovementioned assembly cap 17, shown in FIGS. 3, 4 and 5, penetrating to the inner stops 18 formed by the inner part of a table 19, provided with two lateral fins 20 and reinforcement ribs 21 which surround it, which table 19, which forms an upward extension of the cap 17, culminates in a frustoconical stud 22 which occupies the geometrical center of said cap 17.

The rectangular-prism assembly cap 17 thus constituted is a molded plastic part with thin walls and very light, which is very economical as an element which assures the assembling of a corner of the box, being connected in fitted manner on the triangular protrusion which is formed by the correct folding of the panels 11, 12 and 13. The cap 17 has on its inside two retaining teeth 23 which protrude from the walls which constitute the two legs of the cap and which in the assembling process coincide in position with two angular slots 16 made in the protruding tab 2 of the side 1 and in the protruding tab 10 of the front wall 7, the teeth 23 being hooked in the horizontal sections of the angular slots 16.

Upon attaching a triangular-prism holding cap 17 like that described, in accordance with FIGS. 3 and 4, there is assured an increase in the height of the box upon stacking since the box which is located on top will rest at the corners of its bottom, being supported on the tables 19 of the caps 17 of the immediately lower box, thus assuring its centering and avoiding any possible sliding in any direction, with the introduction of the frustoconical lugs 22 into the slotted openings 15 of the bottom panel 5 belonging to the box which is on top (See FIG. 5).

Thus the clearance between boxes is increased by the distance present between the inner stop plane 18 and the upper plane of the table 19 which is identical in each cap 17, without it being necessary to change the dimensions of the carton blank, together with its mold, in order to obtain greater height of the corner pillars since it has been noted that this increase in height is provided by the caps.

The size, shape and material especially referred to each of the elements which form the unit are variable in that a change may be made in everything which does not presuppose a change in the essence of the object set forth in the above description, which is to be understood in its broadest sense and not as a limitation on possibilities of reduction to practice.

What I claim is:

1. A stackable cardboard box construction comprising a sheet of corrugated cardboard grooved and folded to form a bottom panel, opposite side walls and opposite lengthwise walls united with said bottom panel by grooved fold lines, each of said side walls having at each end thereof an upwardly protruding tab and a flap separated from an upper edge of said side wall and joined with the respective tab by a grooved fold line for folding inwardly, each of said lengthwise walls having at each end thereof an upwardly projecting tab of the same height as said tab of an adjoining side wall and first, second and third panels extending the respective tab, said first, second and third panels being joined with the respective tab and with one another by grooved fold lines for folding inwardly, an end portion of each of said lengthwise walls including the respective tab forming one side of a column of right triangular cross section, said first panel being folded at right angles to said lengthwise wall to form a second side of said column, said second panel being folded at one hundred thirty five degrees to said first panel to form the hypotenuse of said column and said third panel being folded at one hundred thirty-five degrees to said second panel to underlie and reinforce an end portion of said lengthwise wall, an end portion of an adjoining side wall together with the respective tab overlying said first panel on said second side of said column and the respective flap being folded in at one hundred thirty five degrees to said end portion of said side wall to overly said second panel forming the hypotenuse of said column to form at each corner of said box a triangular hollow column having double walls on all sides and projecting up above said side walls and lengthwise walls, a triangular plastic cap fitting over the upwardly projecting portion of each of said triangular columns, each of said caps having a stop plane engaging the upper end of the respective column, a table spaced above said stop plane, a plurality of reinforcing ribs resting on the upper end of said column and extending between said stop plane and said table and a frustoconical stud projecting up from said table, said bottom panel having at each corner portion thereof an opening for reception of said studs of an under-disposed like box.

2. A stackable cardboard box construction according to claim 1, in which each of said caps on the inside of side walls thereof has triangular fastening teeth which engage in angular slots in upwardly protruding portions of the respective column to retain said cap on said column.

3. A stackable cardboard box construction according to claim 1, in which each of said caps has side walls embracing an upwardly projecting part of a respective column, said stop plane being at the level of upper edges of said side walls of said cap and said ribs extending up from said stop plane and supporting said table.

4. A stackable cardboard box construction according to claim 3, in which said table comprises a generally rectangular portion having two sides parallel to said hypotenuse of said column and two sides perpendicular to said hypotenuse and two wings projecting from said two last-mentioned sides.

* * * * *